US005109745A

United States Patent [19]

Tomita

[11] Patent Number: 5,109,745

[45] Date of Patent: May 5, 1992

[54] TREMOLO UNIT FOR AN ELECTRONIC GUITAR

[75] Inventor: Junji Tomita, Hamamatsu, Japan

[73] Assignee: Yamaha Corporation, Hamamatsu, Japan

[21] Appl. No.: 583,181

[22] Filed: Sep. 14, 1990

[30] Foreign Application Priority Data

Sep. 14, 1989 [JP] Japan ..... 1-108242[U]

[51] Int. Cl.[5] ..... G10D 3/00

[52] U.S. Cl. ..... 84/313

[58] Field of Search ..... 84/214, 267, 297 R, 84/298, 307, 312 R, 312 P, 313

[56] References Cited

U.S. PATENT DOCUMENTS 4,611,523 9/1983 McFarland ..... 84/313

*Primary Examiner*—L. T. Hix

*Assistant Examiner*—Howard B. Blankenship

*Attorney, Agent, or Firm*—Spensley Horn Jubas & Lubitz

[57] ABSTRACT

In construction of a tremolo unit for an electric guitar, a bridge is coupled to a swingable bridge base in an arrangement movable in the string direction and provided with a string hole formed there through, a presser piece is received in the string hole for movement in the string direction, and a lock bolt screwed into the bridge forces the presser piece to press a string to the wall of the string hole with a string bead being locked against the lower end of the string hole. A dual fixing mechanism based on string pressing and bead locking well alleviates damage on the string construction caused by pressure application. The bridge and the presser piece are both made of iron-type metal for improvement in tone color of musical tones generated by the electric guitar.

4 Claims, 4 Drawing Sheets

TREMOLO UNIT FOR AN ELECTRONIC GUITAR

BACKGROUND OF THE INVENTION

The present invention relates to a tremolo unit for an electric guitar, and more particularly relates to improvement in function of a combine fixing type tremolo unit used for electric guitars.

In the following descriptions, the term "string direction" refers to the running direction of a string in a stretched state on the body of an electric guitar.

In the general construction of an electric guitar, each string is fixed under tension at one end to a pin secured to the main body of the guitar and, at the other end, to a tremolo unit mounted to the main body at a location remote from the pin in the string direction. As well known, such a tremolo unit is used for causing high speed cyclic change in string tension, thereby providing unique, colourful acoustic effects. More specifically. a tremolo unit includes a bridge base mounted in a swingable arrangement to the main body and a bridge mounted atop the bridge base in on arrangement movable substantially in the string direction. The bridge is provided with a string hole for passage of the associated string.

Depending on the manner of fixing of a string conventional tremolo units are classified into two major groups, i.e. a direct fixing type and on indirect fixing type.

In the case of the direct fixing type, a string bead generally attached to the free end of each string is removed and the string received in the string hole of the bridge is pressed against the wall of the string hole for fixation. One typical example of this direct fixing type is called a Froidrose type, which has no function of octave adjustment. This tremolo unit includes a lock bolt screwed into the bridge in order to press an associated string against the wall of the string hole in the bridge. This lock bolt is accompanied with a fine adjustment screw which adjust the extent of string pressing by the lock bolt.

Such a simple pressing by the lock bolt only is liable to allow uncontrolled slippage and resultant slack of the string. In addition, repeated and frequent application of pressure to a string in the base range tends to damage the coiled structure of the string. Further, the lock bolt is provided with a head of a larger diameter for manual operation. When the lock bolt is screwed into the bridge to press the string in the string hole. movement of the lock bolt may be barred by contact of its enlarged head with the fine adjustment screw. In order to obviate this trouble, the lock bolt is required to have a large length. Such an elongated construction mars compactness of the tremolo unit.

In the case of the indirect fixing type, a string is locked to the bridge of a tremolo unit via the above-described string bead. Examples of this type are proposed in Japanese Utility Model Openings Sho.60-189097, Sho.61-19629 and Sho.62-140593. A bridge used for this indirect fixing type is in general very complicated in construction and, as a consequence, by means of die cast process using non-iron-type metal such as zinc. A bridge made of non-iron-type metal tends to facilitate damping of string vibration and, as a consequence, seriously deteriorate tone colour.

SUMMARY OF THE INVENTION

It is the basic object of the present invention to provide a tremolo unit of a compact construction and simple parts replacement which well suppresses damping of string vibration and, thereby, much improves tone colour of musical tones generated by an electric guitar.

It is another object of the present invention to greatly enhance accuracy in string adjustment on an electric guitar.

In accordance with the present invention, all parts or sections of parts of a tremolo unit to come into contact with strings on an electric guitar are made of iron-type metal, a presser piece is movably received in a string hole formed in a bridge to press an associated string against the hole wall and each string is provided with an end bead to be locked to the distal end of the string hole when the string is stretched.

In a preferred embodiment, an octave adjusting mechanism is attached to a bridge base for the bridge in order to adjust the extent of movement of the bridge on the bridge base.

DESCRIPTION OF THE PREFERRED EMBODIMENTS

Figure 1:
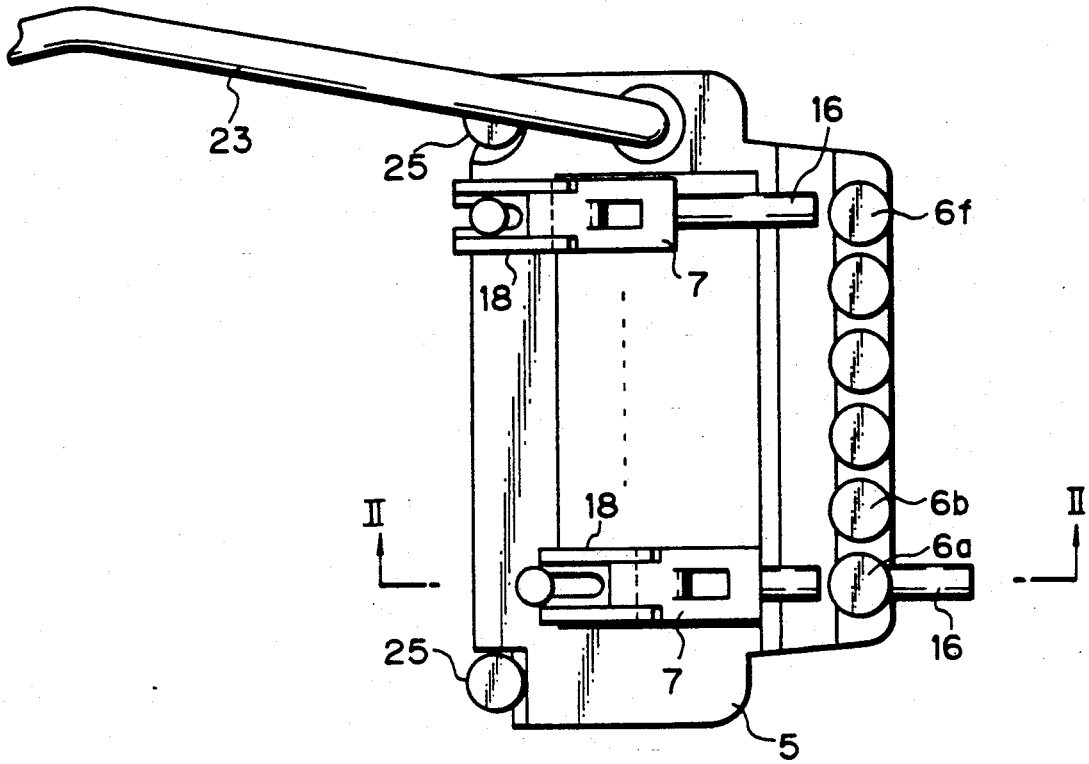
FIG. 1 is one embodiment of the tremolo unit in accord-once with the present invention.
Figure 2:
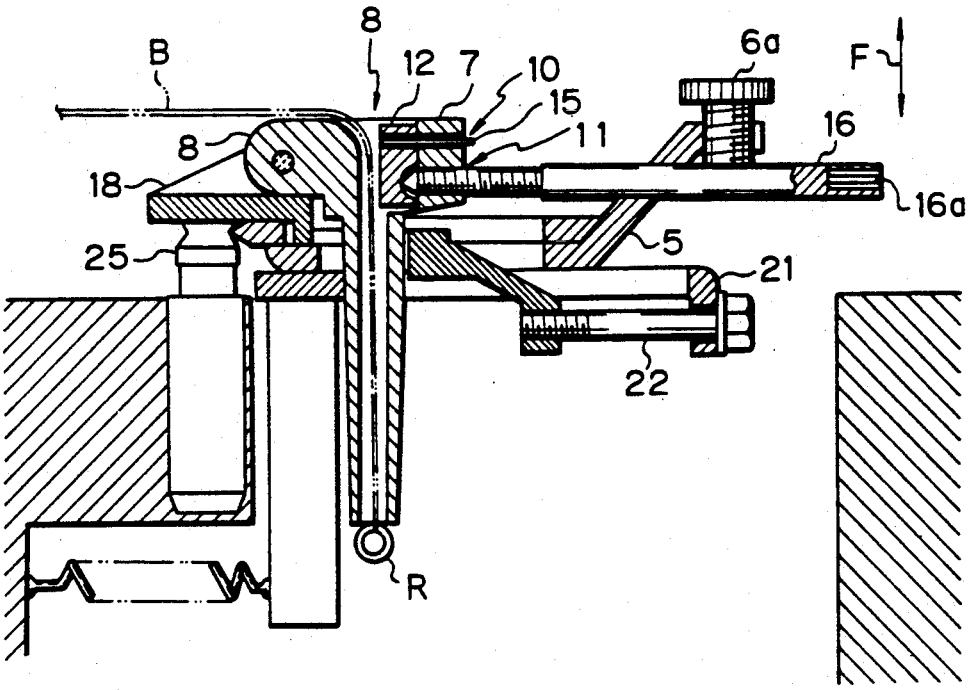
FIG. 2 is a section taken along a line II—II in FIG. 1.
Figure 3:
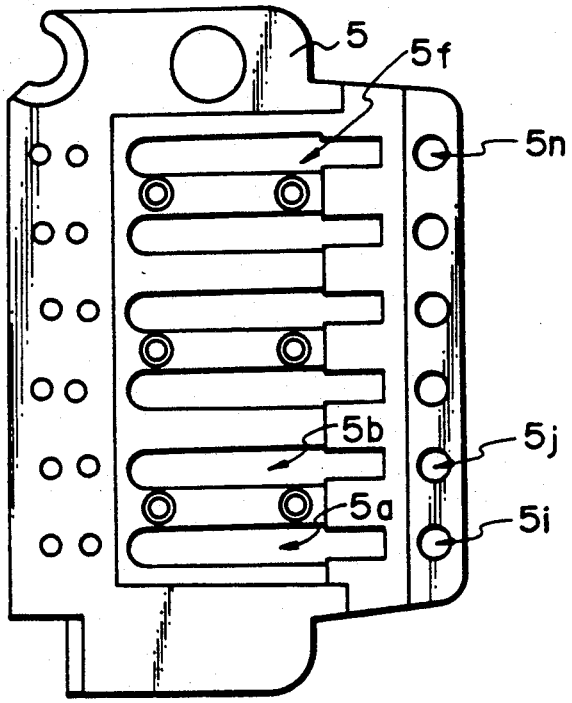
FIG. 3 is a plan view of a bridge base used for the tremolo unit shown in FIGS. 1 and 2.
Figure 4:
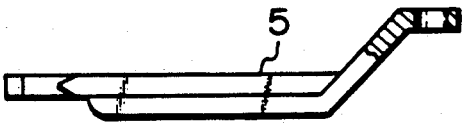
FIG. 4 is a side view of the bridge base.

In the construction of the tremolo unit shown in FIGS. 1 and 2, a bridge base 5 is provided with a plurality of slots 5*a* to 5*f* extending in the string detection and arranged parallel to each other at prescribed intervals as shown in FIG. 3. The bridge base 5 is further provided in its rear section. i.e. the right side section in the illustration, with same number of threaded holes 5*i* to 5*n* arranged side by side at intervals same as those between adjacent slots. As best seen in FIG. 4, the bridge base 5 has a bent construction in which the level of its rear section is higher than that of its fore section. The threaded holes 5*i* to 5*n* in the raised rear section are receptive of fine adjuster screws 6*a* to 6*f* as shown in FIGS. 1 and 2. This bridge base 5 is preferably made of iron-type metal such as iron or stainless steel.

Figure 5A:
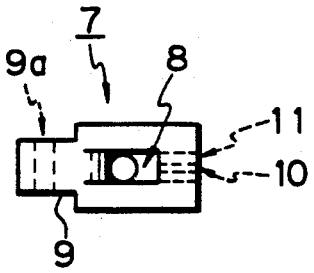
FIGS. 5A to 5C are plan, side and end views of a bridge used for the tremolo unit shown in FIGS. 5, 1 and 2, FIGS. 6A and 6B are plan and side sectional views of a presser piece used for the tremolo unit shown in FIGS. 1 and 2, FIGS. 7A and 7B are plan and side views of a mounting piece used for the tremolo unit shown in FIGS. 1 and 2, and FIGS. 8A to 8C are plan, side and end views of a plate to be coupled to the bridge base.
Figure 5B:
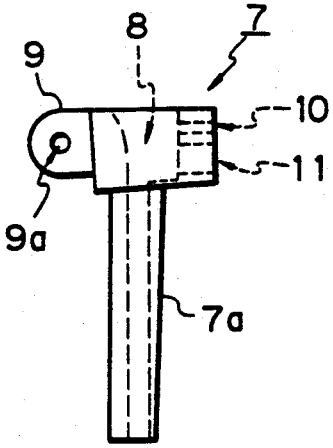
Figure 5C:
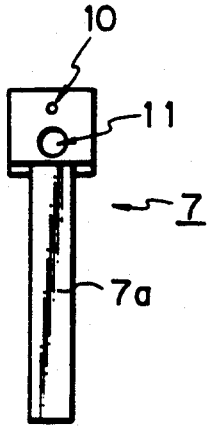

Each slot in the fore section of the bridge base 5 is receptive of the lower extension 7*a* of a bridge 7 in an arrangement movable in the string direction. As shown in FIGS. 5A to 5C, the bridge 7 is provided with a string hole 8 which runs vertically and terminates at the lower end of the lower extension 7*a*. The string hole 8 is made up an upper square section and a lower cylindrical section. The bridge 7 is provided with a fore projection 9 having a transverse through hole 9*a*. A pin hole 10 and a threaded hole 11 are formed opening in the rear face of the bridge 7 and in the upper square section of the string hole 8 whilst being somewhat spaced from each other on the vertical direction. The bridge 7 is also made of iron-type metal at least in a section for contact with a string to be inserted into the string hole 8.

Figure 6A:
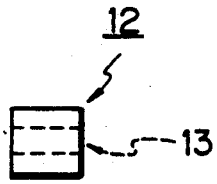
Figure 6B:
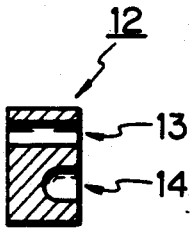

A presser piece 12 is placed in the upper square section of the string hole 8 of each bridge 7. This presser piece 12 is preferably made of iron-type metal also. As shown in FIGS. 6A and 6B, the presser piece 12 is provided with a pin hole 13 which runs in the string direction when placed in the string hole 8. The presser piece 12 is also provided with a rear recess 14 formed below the pin hole 13. As seen in FIG. 2, the presser piece 12 in the string hole 8 is connected to the bridge 7 by means of a pin 15 inserted through the pin hole 10 in the bridge 7 and the pin hole 13 in the presser piece 12 so that the presser piece 12 should be movable in the string direction in the square section of the string hole 8. To this end, the length of the pin 15 is chosen so that the presser piece 12 shown not fall out of engagement with the pin 15 even when the presser piece 12 is in the foremost position in the square section of the string hole 8.

A lock bolt 16 is screwed into the threaded hole 11 in the bridge 7 so that its point should intrude into the rear recess 14 of the presser piece 12 for the above-described movement of the latter. The lock bolt 16 is provided at its rear end with an angled bore 16*a* adapted for turning by a proper screw driver.

Figure 7A:
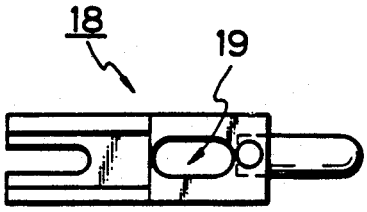

The tremolo unit in accordance with the present invention further includes a mounting piece 18 used for coupling the bridge 7 to the bridge base 5. As shown in FIG. 7A, the mounting piece 18 is provided with a center slot 19 elongated in the string direction in order to receive the lower extension 7*a* of the bridge 7. The mounting piece 18 is further provided in its rear, lower section with a threaded hole 20 extending in the string direction.

Figure 8A:
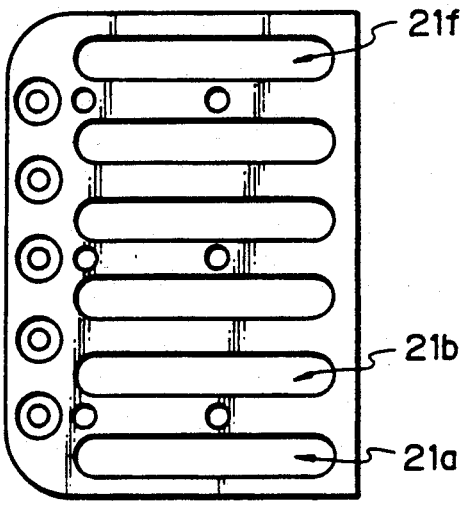
Figure 8B:
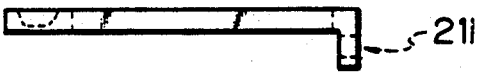
Figure 8C:
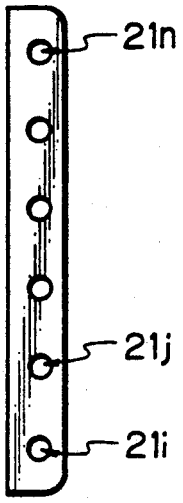

A plate 21 such as shown in FIGS. 8A to 8C is attached to the bridge base 5. More specifically, the plate 21 is provided with a plurality of slots 21*a* to 21*f* as shown in FIG. 8A. The shape and orientation of the slots in the plate are same as those of the slots 5*a* to 5*f* in the bridge base 5 shown in FIG. 3. As seen in FIG. 8B, the plate 21 is provided with a lower bent section in which through holes 21*i* to 21*n* are formed as shown in FIG. 8C. The plate 21 and the bridge base 5 are coupled together so that the slots in the plate 21 should meet the slots in the bridge base 5. The plate 21 is preferably made of iron-type metal also.

Figure 7B:
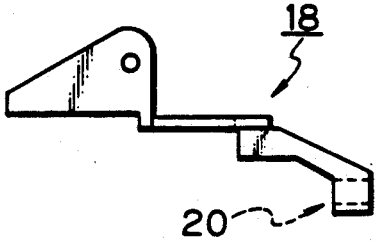

As shown in FIG. 2, a bolt 22 is screwed into the threaded hole 20 (see FIG. 7B) in the mounting piece 18 past the through hole 21*i* (see FIG. 8B) in the plate 21 to move the mounting piece 18 in the string direction with respect to the bridge base 5. Following this movement, the bridge 7 carried by the mounting piece 18 also moves in a same fashion. The mounting piece 18, the plate 21 and the bolt 22 form an octave adjusting mechanism.

The bridge base B is connected to a fixed column 25 in a vertically swingable arrangement so that, when a tremolo arm 23 secured to the bridge base 5 is manually operated, the tremolo unit as a whole should swing about the column 25 in a direction shown with an arrow F in FIG. 2.

The tremolo unit of the above-described construction operates as follows.

For fixing of a string B, the string B is inserted into the string hole 8 of the bridge 7 until its end bead R is locked at the lower end of the string hole 8 as shown in FIG. 2. The other end of the string B is connected to a neck (not shown) provided on the main body of the electric guitar. After stretching the string B, the lock bolt 16 is screwed into the threaded hole 11 in the bridge 7 to press the string B to the wall of the string hole 8 by a corresponding forward movement of the presser piece 12.

In addition to fixing by pressured from the presser unit 12, the end bead R of the string B is locked at the end of the string hole 8. Thanks to such a dual fixing mechanism, no slippage of the string B occurs during performance even when the pressure applied by the presser piece is not so high as to damage the string B. In other words, even in case of a coil-type string in the bass range, the initial coiled structure of the string can well endure repeated and frequent pressure application.

For replacement of the string B, the lock bolt 16 is turned to remove the pressure applied via the presser piece 12. Since the pin 15 is long enough to keep the presser piece 12 constantly with the string hole 8 in the bridge 7, the presser piece 12 does never fall off the tremolo unit even when the electric guitar is placed upside down during the replacement.

Because the bridge 7 and at least the section of the presser piece 12 for direct contact with the string B are both made of iron-type metal such as iron or stainless steel, damping of string vibration is much suppressed to improve tone colour of musical tones generated by the electric guitar.

The lock bolt 16 is operated via the angled bore 16*a* formed in its rear end and, as a consequence, is provided with no enlarged head for manual operation. In other words, movement of the lock bolt 16 is not barred by presence of the fine adjuster screw 6*a* and no extra length is required for the lock bolt 16, thereby providing a compact construction of the tremolo unit.

Use of the octave adjusting mechanism assures high accuracy in string adjustment.

I claim:

1. A tremolo unit for an electric guitar in combination with a guitar string, the combination comprising a bridge base mounted in a vertically swingable arrangement to a main body of said electric guitar, a bridge mounted to said bridge base in an arrangement movable substantially in a string direction, provided with a string hole formed there through, and made of a metal selected from the group consisting of iron and stainless steel, a presser piece received in said string hole of said bridge in an arrangement contactable with a string inserted into said string hole and made of a metal selected from the group consisting of iron and stainless steel at least in a section for contact with said string, said string being provided with an end bead to be locked to a lower end of said string hole when stretched, means for connecting said presser piece to said bridge in a movable arrangement, and a lock bolt screwed into said bridge to urge said presser piece to press said string against a wall of said string hole.

2. A tremolo unit as claimed in claim 1 further comprising an octave adjusting mechanism attached to said bridge base to adjust the extend of movement of said bridge with respect to said bridge base.

3. A tremolo unit as claimed in claim 2 in which said octave adjusting mechanism includes a plate secured to said main body of said electric guitar whilst carrying said bridge base, and provided with first slots elongated in said string direction, a mounting piece received in each said first slot of said plate and provided with second slots each of which is elongated in said string direction and receptive of said bridge, and a bolt screwed into said mounting piece past said plate so that manual turning of said bolt causes movement of said mounting piece with said bridge within a first slot.

4. A tremolo unit as claimed in claim 1 or 2 in which said connecting means includes a pin inserted into said presser piece past said bridge.

* * * * *